US010067434B2

(12) United States Patent
Morales-Tirado et al.

(10) Patent No.: US 10,067,434 B2
(45) **Date of Patent: *Sep. 4, 2018**

(54) EMULSION AGGREGATION TONERS

(71) Applicant: XEROX CORPORATION, Norwalk, CT (US)

(72) Inventors: Juan A. Morales-Tirado, Henrietta, NY (US); David John William Lawton, Oakville (CA); Vincenzo G. Marcello, Penfield, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/469,116

(22) Filed: Mar. 24, 2017

(65) Prior Publication Data

US 2017/0199472 A1 Jul. 13, 2017

Related U.S. Application Data

(63) Continuation of application No. 14/051,839, filed on Oct. 11, 2013.

(51) Int. Cl.

*G03G 9/08* (2006.01)
*G03G 9/087* (2006.01)
*G03G 9/09* (2006.01)

(52) U.S. Cl.

CPC ..... *G03G 9/0804* (2013.01); *G03G 9/0819* (2013.01); *G03G 9/0827* (2013.01); *G03G 9/08711* (2013.01); *G03G 9/08782* (2013.01); *G03G 9/0904* (2013.01)

(58) Field of Classification Search

CPC ..... G03G 9/0804; G03G 9/0904; G03G 9/08711; G03G 9/08782; G03G 9/0827; G03G 9/0819

See application file for complete search history.

(56) References Cited

U.S. PATENT DOCUMENTS 3,847,604 A 11/1974 Hagenbach et al.
4,295,990 A 10/1981 Verbeek et al.
4,935,326 A 6/1990 Creatura et al.
4,937,166 A 6/1990 Creatura et al.
5,236,629 A 8/1993 Mahabadi et al.
5,278,020 A 1/1994 Grushkin et al.
5,290,654 A 3/1994 Sacripante et al.
5,308,734 A 5/1994 Sacripante et al.
5,330,874 A 7/1994 Mahabadi et al.
5,344,738 A 9/1994 Kmiecik-Lawrynowicz et al.
5,346,797 A 9/1994 Kmiecik-Lawrynowicz et al.
5,348,832 A 9/1994 Sacripante et al.
5,364,729 A 11/1994 Kmiecik-Lawrynowicz et al.
5,366,841 A 11/1994 Patel et al.
5,370,963 A 12/1994 Patel et al.
5,403,693 A 4/1995 Patel et al.
5,405,728 A 4/1995 Hopper et al.
5,418,108 A 5/1995 Kmiecik-Lawrynowicz et al.
5,496,676 A 3/1996 Croucher et al.
5,501,935 A 3/1996 Patel et al.
5,527,658 A 6/1996 Hopper et al.
5,585,215 A 12/1996 Ong et al.
5,650,255 A 7/1997 Ng et al.
5,650,256 A 7/1997 Veregin et al.
5,723,253 A 3/1998 Higashino et al.
5,744,520 A 4/1998 Kmiecik-Lawrynowicz et al.
5,747,215 A 5/1998 Ong et al.
5,763,133 A 6/1998 Ong et al.
5,766,818 A 6/1998 Smith et al.
5,804,349 A 9/1998 Ong et al.
5,827,633 A 10/1998 Ong et al.
5,840,462 A 11/1998 Foucher et al.
5,853,944 A 12/1998 Foucher et al.
5,863,698 A 1/1999 Patel et al.
5,869,215 A 2/1999 Ong et al.
5,902,710 A 5/1999 Ong et al.
5,910,387 A 6/1999 Mychajlowskij et al.
5,916,725 A 6/1999 Patel et al.
5,919,595 A 7/1999 Mychajlowskij et al.
5,925,488 A 7/1999 Patel et al.
5,977,210 A 11/1999 Patel et al.
6,120,967 A 9/2000 Hopper et al.
6,576,389 B2 6/2003 Vanbesien et al.
6,617,092 B1 9/2003 Patel et al.
6,627,373 B1 9/2003 Patel et al.
6,638,677 B2 10/2003 Patel et al.
6,656,657 B2 12/2003 Patel et al.
6,656,658 B2 12/2003 Patel et al.
6,664,017 B1 12/2003 Patel et al.
6,673,505 B2 1/2004 Jiang et al.
7,037,633 B2 5/2006 Hopper et al.
9,182,691 B2 * 11/2015 Lawton ..... G03G 9/0804
2005/0136350 A1 6/2005 Marcello
2007/0020553 A1 1/2007 Marcello
2010/0092886 A1 4/2010 Vanbesien et al.
2011/0318685 A1 12/2011 Vanbesien et al.
2012/0258398 A1 10/2012 Zhou et al.
2015/0104742 A1 4/2015 Morales-Tirado et al.

FOREIGN PATENT DOCUMENTS

GB 1442835 7/1976

* cited by examiner

*Primary Examiner* — Thorl Chea
(74) *Attorney, Agent, or Firm* — Pillsbury Winthrop Shaw Pittman LLP

(57) ABSTRACT

A continuous flow process for producing coalesced toner particles from aggregated toner particles includes continuously flowing a slurry of aggregated toner particles having a size of from about 5 microns to about 7 microns through one or more heat exchangers, wherein a residence time in the one or more heat exchangers is from about 1 second to about 15 minutes, thereby producing coalesced toner particles having a circularity of from about 0.930 to about 0.990. The aggregated toner particles comprise a polymer resin, a colorant, an aggregating agent, and an optional wax.

13 Claims, 3 Drawing Sheets

EMULSION AGGREGATION TONERS

CROSS REFERENCE TO RELATED APPLICATION

This application is a continuation application of co-pending U.S. patent application Ser. No. 14/051,839, filed Oct. 11, 2013.

BACKGROUND

This disclosure is directed to toner compositions with improved rheological properties.

Emulsion aggregation (EA) toners are used in forming print and/or xerographic images. Emulsion aggregation techniques typically involve the formation of an emulsion latex of resin particles that have a small size of from, for example, about 5 to about 500 nanometers in diameter, by heating the resin, optionally with solvent if needed, in water, or by making a latex in water using an emulsion polymerization. A colorant dispersion, for example of a pigment dispersed in water, optionally with additional resin, may be separately formed. The colorant dispersion may be added to the emulsion latex mixture, and an aggregating agent or complexing agent may then be added and/or aggregation may otherwise be initiated to form aggregated toner particles. The aggregated toner particles may be heated to enable coalescence/fusing, thereby achieving aggregated, fused toner particles. Exemplary emulsion aggregation toners include acrylate-based toners, such as those based on styrene acrylate toner particles as illustrated in, for example, U.S. Pat. No. 6,120,967, the disclosure of which is totally incorporated herein by reference.

In conventional EA processes, batch processes may be used for preparing toners. Batch processes feature long processing times and consume a great deal of energy. The heating/coalescence process is particularly time and energy intensive, as the entire batch is heated to the desired coalescence temperature and maintained at that temperature for coalescence to occur. For example, in large-scale production of EA toner, increasing the temperature of toner to the desired coalescence temperature and carrying out the coalescence step may take upwards of 10 hours.

Additionally, in a batch process, high jacket temperatures and low fluid velocity at the walls under stirring can lead to fouling of the reactor walls. This necessitates additional down-time in the production cycle to allow for cleaning in order to restore the heat transfer from the jacket to the fluid in the vessel. This additional down-time further increases the total amount of time for running an extended production cycle to allow for cleaning after a set number of batches.

Furthermore, in batch processing, controlling or adjusting the rheology of a toner is difficult. The rheology of toner particles is one factor that determines the interaction between the toner and the fusing subsystem components. The viscosity and elasticity of the particles are known to have an impact on crease area, fix, offset performance, and also image permanence. Not having the right rheology can lead to defects such as streaks, spots, and smudges. These defects may be caused by the toner not adhering to the substrate, toner not melting completely, or toner contaminating the fuser roll, cleaning web, and stripping fingers. Other issues such as poor fix on the media can be observed.

Therefore, there is a need for improved toners with improved rheological properties.

SUMMARY

The present disclosure provides for toner compositions comprising toner particles, wherein the toner particles have an elastic modulus in the range of about 100 Pa to about 1050 Pa.

The present disclosure also provides for toner compositions comprising toner particles, wherein the toner particles have a viscous modulus in the range of about 100 Pa to about 1000 Pa.

A composition comprising toner particles is also described herein, wherein the toner particles have an elastic modulus in the range of about 100 Pa to about 1050 Pa and/or have a viscous modulus in the range of about 500 Pa to about 1000 Pa, and wherein the toner particles are formed by a continuous coalescence process.

EMBODIMENTS

Figure 1:
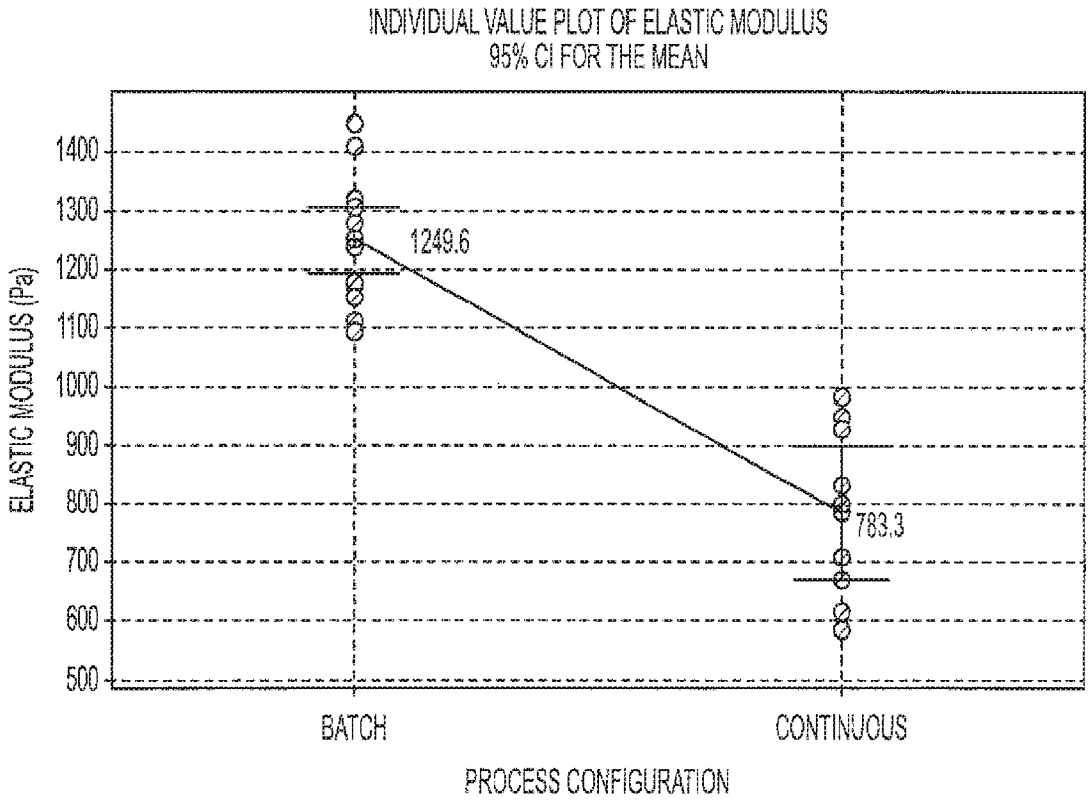
FIG. 1 is a graph comparing the elastic modulus between toner particles of the same formulation, except one group of toner particles were produced in a batch process and the other group was produced in a continuous process.

In this specification and the claims that follow, singular forms such as "a," "an," and "the" include plural forms unless the content clearly dictates otherwise. All ranges disclosed herein include, unless specifically indicated, all endpoints and intermediate values. The term "at least one" refers, for example, to instances in which one of the subsequently described circumstances occurs, and to instances in which more than one of the subsequently described circumstances occurs.

The term "continuous" refers, for example, to a process that may be performed without interruption, such as a process in which raw materials are continuously processed to completed products. While a continuous process may thus be conducted 24 hours per day, 7 days per week, it is understood that the process may be periodically stopped, for example, for maintenance purposes.

"Optional" or "optionally" refer, for example, to instances in which subsequently described circumstance may or may not occur, and include instances in which the circumstance occurs and instances in which the circumstance does not occur.

The terms "one or more" and "at least one" refer, for example, to instances in which one of the subsequently described circumstances occurs, and to instances in which more than one of the subsequently described circumstances occurs. Similarly, the terms "two or more" and "at least two" refer, for example to instances in which two of the subsequently described circumstances occurs, and to instances in which more than two of the subsequently described circumstances occurs.

"High gloss" refers, for example, to the gloss of a material being from about 20 to about 100 gloss units, such as from about 30 to about 90 gloss units (GGU), or from about 40 to about 70 GGU or from about 45 to about 75 GGU, as measured by a Gardner Gloss metering unit; on a coated paper, such as Xerox 120 gsm Digital Coated Gloss papers, or on plain paper such as Xerox 90 gsm Digital Color Xpressions+paper.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

The term "room temperature" refers, for example, to a temperature of from about 20° C. to about 25° C.

The present disclosure provides for toner particles with improved rheological properties. For example, the elastic modulus and viscous modulus may be improved compared to previous processes, for example, when compared to toner particles produced entirely by a batch process. The toner particles may optionally have a core/shell structure. The toner particles produced by the methods of the present disclosure are optionally high-gloss toner particles.

Toner Particles

The toner particles described herein have improved rheological properties, such as, for example, an improved elastic modulus or viscous modulus, compared to a same toner produced entirely by a batch process. For example, the toner particles described herein may have an elastic modulus in the range of about 100 Pa to about 1050 Pa, from about 300 Pa to about 1025 Pa, or from about 500 Pa to about 1000 Pa. Additionally, for example, the toner particles produced by the methods described herein may have a viscous modulus in the range of about 100 Pa to about 1000 Pa, from about 500 Pa to about 900 Pa, or from 600 Pa to about 850 Pa.

Furthermore, by subjecting the toner particles to the processes described herein, the elastic modulus may be decreased by about 5% to about 75%, for example, about 8% to about 70%, or from about 9% to about 65% compared to a same toner produced entirely by a batch process. In addition, by subjecting the toner particles to the processes described herein, the viscous modulus of the toner may be decreased by about 5% to about 65%, by about 10% to about 60%, or from about 15% to about 55% compared to a same toner produced entirely by a batch process.

The elastic modulus and viscous modulus may be measured using, for example, a rheometer, for example, an ARES-G2 parallel plate rheometer. When measuring the elastic modulus and viscous modulus, the toner particles may be compressed into about a 1 inch pellet by compressing about 0.8 grams of toner particles under a pressure of about 5 bars and holding the pressure for about 0.3 minutes. The starting sample temperature is about 100° C. and it is stepped up by about 20° C. until the sample reaches a temperature of about 220° C. A logarithmic frequency sweep is performed at each temperature from about 0.1 radians per second to about 100 radians per second and collecting five data points per decade at a strain of 10%. The viscous modulus and elastic modulus are determined from the ratio of the stress to strain at the different conditions (temperature and stress) under which the sample is exposed.

The emulsion/aggregation toner particles, which optionally may be toner particles having a core/shell structure (as discussed below), which may be produced by the methods described herein, are generally derived from at least a latex emulsion polymer resin and a colorant dispersion. The toner particles may also include a wax and other optional additives.

Resins

Any monomer suitable for preparing a latex for use in a toner may be utilized. Such latexes may be produced by conventional methods. For example, the toner may be produced by emulsion aggregation. Suitable monomers useful in forming a latex emulsion, and thus the resulting latex particles in the latex emulsion, include, for example, styrenes, acrylates, methacrylates, butadienes, isoprenes, acrylic acids, methacrylic acids, acrylonitriles, combinations thereof, and the like.

The resin used to form the latex may be crystalline and/or amorphous, and may include at least one polymer, such as from about 1 to about 20 polymers, or from about 3 to about 10 polymers. Example polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof. The polymer may be block, random, or alternating copolymers. Polyester resins may optionally be omitted from the resins used to make the latex.

For example, a poly(styrene-butyl acrylate) may be utilized as the resin to form the latex. The glass transition temperature of this example latex may be from about 35° C. to about 75° C., such as from about 40° C. to about 70° C.

Surfactants

Toner particles may be formed by emulsion aggregation methods where the resin and other components of the toner are placed in contact with one or more surfactants, an emulsion is formed, the toner particles are aggregated, coalesced, optionally washed and dried, and recovered.

One, two, or more surfactants may be used. The surfactants may be selected from ionic surfactants and nonionic surfactants. Anionic surfactants and cationic surfactants are encompassed by the term "ionic surfactants." The surfactant may be present in an amount of from about 0.01 to about 5 wt % of the toner composition, such as from about 0.75 to about 4 wt % weight of the toner composition, or from about 1 to about 3 wt % of the toner composition.

Examples of suitable nonionic surfactants include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octyiphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA210™, IGEPAL CA520™ IGEPAL CA-720™, IGEPAL CO-890™, IGEPAL CO-720™, IGEPAL CO290™ IGEPAL CA-210™, ANTAROX 890™, and ANTAROX 897™. Other examples of suitable nonionic surfactants include a block copolymer of polyethylene oxide and polypropylene oxide, including those commercially available as SYNPERONIC PE/F, such as SYNPERONIC PE/F 108.

Suitable anionic surfactants include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, DOWFAX™ 2 A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be used.

Examples of cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, cetyl pyridinium bromide, benzalkonium chloride, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Initiators

Initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine) dihydrochloride, 2,2'-azobis[N-(4-chlorophenyl)-2-methylpropionamidine]dihydrochloride, 2,2'-azobis[N-(4-hydroxyphenyl)-2-methylpropionamidine]dihydrochloride, 2,2'-azobis[N-(4-amino-phenyl)-2-methylpropionamidine] tetrahydrochloride, 2,2'-azobis[2-methyl-N(phenylmethyl) propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochl-oride, 2,2'-azobis[2-(3,4,5,6-tetrahydropyrimidin-2-yl)propane]dihydrochlo-ride, 2,2'-azobis[2-(5-hydroxy-3,4,5,6-tetrahydropyrimidin-2-yl) propane]di-hydrochloride, 2,2'-azobis{2-[1-(2-hydroxyethyl)-2-imidazolin-2-yl]propane}dihydrochloride, combinations thereof, and the like.

Initiators may be added in suitable amounts, such as from about 0.1 to about 8 wt %, or from about 0.2 to about 5 wt % of the monomers.

Chain Transfer Agents

Chain transfer agents may also be utilized in forming the latex. Suitable chain transfer agents include, for example, dodecane thiol, octane thiol, carbon tetrabromide, combinations thereof, and the like. Where utilized, chain transfer agents may be present in amounts from about 0.1 to about 10%, such as from about 0.2 to about 5% by weight of monomers, to control the molecular weight properties of the polymer when emulsion polymerization is conducted in accordance with the present disclosure.

Stabilizers

A stabilizer may be used in forming the latex. Suitable stabilizers include monomers having carboxylic acid functionality. Such stabilizers may be of the following formula (I):

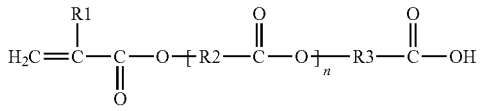

(I)

where R1 is hydrogen or a methyl group; R2 and R3 are independently selected from alkyl groups containing from about 1 to about 12 carbon atoms or a phenyl group; n is from about 0 to about 20, or from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

The stabilizer having carboxylic acid functionality may also contain a small amount of metallic ions, such as sodium, potassium, and/or calcium, to achieve better emulsion polymerization results. The metallic ions may be present in an amount from about 0.001 to about 10% by weight of the stabilizer having carboxylic acid functionality, such as from about 0.5 to about 5% by weight of the stabilizer having carboxylic acid functionality.

Where present, the stabilizer may be added in amounts from about 0.01 to about 5% by weight of the toner, for example, from about 0.05 to about 2% by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. A stabilizer may include a composition containing sodium silicate dissolved in sodium hydroxide.

pH Adjustment Agent

A pH adjustment agent may be added to control the rate of the emulsion aggregation process. The pH adjustment agent can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof. The pH adjustment agent may be added, for example, during the aggregation process to increase or decrease the rate at which the toner particles are aggregated.

Waxes

In addition to the polymer binder resin, the toners may also contain a wax, either a single type of wax or a mixture of two or more different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes may be added to provide multiple properties to the toner composition.

Examples of suitable waxes include waxes selected from natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, panic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

The wax may be selected from polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K. K., and similar materials. The commercially available polyethylenes usually possess a molecular weight (Mw) of from about 500 to about 2,000, such as from about 1,000 to about 1,500, while the commercially available polypropylenes used have a molecular weight of from about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., and chlorinated polyethylenes and polypropylenes commercially available from Allied Chemical and Petrolite Corporation and Johnson Diversey, Inc. The polyethylene and polypropylene compositions may be selected from those illustrated in British Pat. No. 1,442,835, the entire disclosure of which is incorporated herein by reference.

The toners may contain the wax in any amount of from, for example, about 1 to about 25 wt % of the toner, such as from about 3 to about 15 wt % of the toner, on a dry basis; or from about 5 to about 20 wt % of the toner, or from about 5 to about 11 wt % of the toner.

In addition, it has been found that when a wax is included in toner particles produced by a continuous process, for example, in the continuous process described herein, less wax is on the surface of the toner particles when compared to a same toner particle entirely produced using a batch process.

For example, at room temperature, about 1% to about 10%, about 2% to about 9%, or from about 3% to about 8% of the surface of the toner particles may be coated with the wax. At about 55° C., for example, about 5% to about 20%, about 6% to about 15%, or from about 7% to about 12% of the surface of the toner particle is coated with the wax. At about 75° C., about 40% to about 85%, about 50% to about 83%, or from about 55% to about 80% of the surface of the toner particle is coated with the wax. In addition, at room temperature, the wax on the surface of the toner particle made by the processes described herein may be reduced by about 1% to about 100%, by about 5% to about 85%, or by about 6% to about 75% when compared to a same toner particle produced entirely by a batch process. At 55° C., the wax on the surface of the toner particle made by the processes described herein may be reduced by about 40% to about 90%, by about 50% to about 80%, or by about 60% to about 70% when compared to a same toner particle entirely produced by a batch process. At 75° C., the wax on the surface of the toner particle made by the process described herein may be reduced by about 5% to about 50%, by about 10% to about 45%, or by about 12% to about 40% when compared to a same toner particle entirely produced by a batch process.

In some instances and for some imaging systems, wax on the surface of the toner particle may result in the toner particle sticking to, for example, a fuser roll. This may lead to undesirable smudging or smearing.

Colorants

The toners may also contain at least one colorant. Colorants or pigments include pigments, dyes, mixtures of pigment and dye, mixtures of pigments, mixtures of dyes, and the like. "Colorant" refers, for example, to colorants, dyes, pigments, and mixtures, unless specified as a particular pigment or other colorant component. The colorant may comprise a pigment, a dye, mixtures thereof, carbon black, magnetite, black, cyan, magenta, yellow, red, green, blue, brown, and mixtures thereof, in an amount of about 0.1 to about 35 wt % based upon the total weight of the composition, such as from about 1 to about 25 wt %.

In general, colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF), and carbon blacks such as REGAL 330 (Cabot), Carbon Black 5250 and 5750 (Columbian Chemicals), and the like, and mixtures thereof.

Additional colorants include pigments in water-based dispersions such as those commercially available from Sun Chemical, for example SUNSPERSE BHD 6011 X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 12273915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226), and the like, and mixtures thereof. Other water based colorant dispersions include those commercially available from Clariant, for example, HOSTAFINE Yellow GR, HOSTAFINE Black T and Black TS, HOSTAFINE Blue B2G, HOSTAFINE Rubine F6B, and magenta dry pigment such as Toner Magenta 6BVP2213 and Toner Magenta E02 that may be dispersed in water and/or surfactant prior to use.

Other colorants include, for example, magnetites, such as Mobay magnetites M08029, M08960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like, and mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E. D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E. I. DuPont de Nemours & Company, and the like. Examples of magentas include, for example, 2,9-dimethyl substituted quinacridone and anthraquinone dye identified in the Color Index as CI 60710, CI Dispersed Red 15, diazo dye identified in the Color Index as CI 26050, CI Solvent Red 19, and the like, and mixtures thereof. Examples of cyans include copper tetra(octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like, and mixtures thereof. Examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components, may also be selected as pigments.

The colorant, such as carbon black, cyan, magenta, and/or yellow colorant, is incorporated in an amount sufficient to impart the desired color to the toner. In general, pigment or dye is employed in an amount ranging from about 1 to about 35 wt % of the toner particles on a solids basis, such as from about 5 to about 25 wt %, or from about 5 to about 15 wt %.

Coagulants

Coagulants used in emulsion aggregation processes for making the toners described herein include monovalent metal coagulants, divalent metal coagulants, polyion coagulants, and the like. As used herein, "polyion coagulant" refers to a coagulant that is a salt or an oxide, such as a metal salt or a metal oxide, formed from a metal species having a valence of at least 3, at least 4, or at least 5. Suitable coagulants include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds may have from about 2 to about 13, such as from about 3 to about 8, aluminum ions present in the compound.

The coagulants may be incorporated into the toner particles during particle aggregation. As such, the coagulant may be present in the toner particles, exclusive of external additives and on a dry weight basis, in amounts of from 0 to about 5 wt % of the toner particles, such as from about greater than 0 to about 3 wt % of the toner particles.

Aggregating Agents

Any aggregating agent capable of causing complexation may be used in forming toners of the present disclosure. Both alkaline earth metal and transition metal salts may be utilized as aggregating agents. Alkaline earth salts can be selected to aggregate latex resin colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

Sequestering Agents

An organic sequestering agent may be added to the mixture during aggregation of the particles. Such sequestering agents and their use in forming toners are described, for example, in U.S. Pat. No. 7,037,633, the disclosure of which is hereby incorporated by reference in its entirety. Examples of organic sequestering agents include, organic acids such as ethylene diamine tetra acetic acid (EDTA), GLDA (commercially available L-glutamic acid N,N diacetic acid), humic and fulvic acids, peta-acetic and tetra-acetic acids; salts of organic acids including salts of methylglycine diacetic acid (MGDA), and salts of ethylenediamine disuccinic acid (EDDS); esters of organic acids including sodium gluconate, magnesium gluconate, potassium gluconate, potassium and sodium citrate, nitrotriacetate (NTA) salt; substituted pyranones including maltol and ethyl-maltol; water soluble polymers including polyelectrolytes that contain both carboxylic acid (COOH) and hydroxyl (OH) functionalities; and combinations thereof. Examples of specific sequestering agents include, for example:

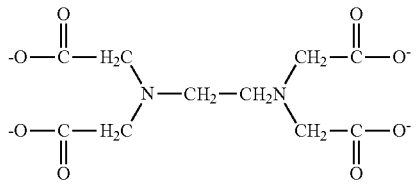

EDTA

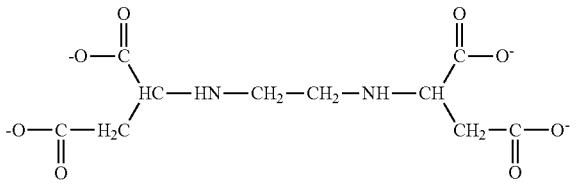

EDDS

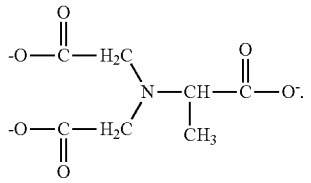

MGDA

EDTA, a salt of methylglycine diacetic acid (MGDA), or a salt of ethylenediamine disuccinic acid (EDDS), may be utilized as a sequestering agent.

The amount of sequestering agent added may be from about 0.25 parts per hundred (pph) to about 4 pph, such as from about 0.5 pph to about 2 pph. The sequestering agent complexes or chelates with the coagulant metal ion, such as aluminum, thereby extracting the metal ion from the toner aggregate particles. The amount of metal ion extracted may be varied with the amount of sequestering agent, thereby providing controlled crosslinking. For example, adding about 0.5 pph of the sequestering agent (for example, EDTA) by weight of toner, may extract from about 40 to about 60% of the aluminum ions, while the use of about 1 pph of the sequestering agent may result in the extraction of from about 95 to about 100% of the aluminum.

Developer

The toner particles disclosed herein may be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, from about 2% to about 15% by weight of the total weight of the developer, or from about 2% to about 10% by weight of the total weight of the developer. The toner concentration may be from about 90% to about 98% by weight of the carrier. However, different toner and carrier percentages may be used to achieve a developer composition with desired characteristics.

Carrier

Examples of carrier particles that may be selected for mixing with the toner composition prepared in accordance with the present disclosure include those particles that are capable of triboelectrically obtaining a charge of opposite polarity to that of the toner particles. The carrier particles may be selected so as to be of a negative polarity in order that the toner particles that are positively charged will adhere to and surround the carrier particles. Examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. The carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used.

Polyvinylidenefluoride and polymethylmethacrylate (PMMA) may be mixed in proportions of from about 30 weight % to about 70 weight %, from about 40 weight % to about 60 weight %, or from about 45 weight % to about 55 weight %. The coating may have a coating weight of, for example, from about 0.1 weight % to about 5% by weight of the carrier, from about 0.5 weight % to about 2% by weight of the carrier.

PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, from about 0.01 weight % to about 3 weight %, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

Suitable carriers may include a steel core, for example of from about 25 to about 100 μm in size, from about 50 to about 75 μm in size, coated with about 0.5% to about 10% by weight, from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition, such as from about 3% to about 18%, or from about 5% to about 15%. However, different toner and carrier percentages may be used to achieve a developer composition with desired characteristics.

Imaging

The toners disclosed herein may be used in electrostatographic (including electrophotographic) or xerographic imaging methods, including those disclosed in, for example, U.S. Pat. No. 4,295,990, the disclosure of which is hereby incorporated by reference in its entirety. Any known type of image development system may be used in an image developing device, including, for example, magnetic brush development, jumping single-component development, hybrid scavengeless development (HSD), and the like.

Imaging processes include, for example, preparing an image with a xerographic device including a charging component, an imaging component, a photoconductive component, a developing component, a transfer component, and a fusing component. The development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. The toners may be used in developing an image in an image-developing device using a fuser roll member. Fuser roll members are contact fusing devices that are within the purview of those skilled in the art, in which heat and pressure from the roll may be used to fuse the toner to the image-receiving medium. The fuser member may be heated to a temperature above the fusing temperature of the toner, for example to temperatures of from about 70° C. to about 150° C., from about 80° C. to about 145° C., or from about 90° C. to about 140° C., after or during melting onto the image receiving substrate.

Example Method to Produce Toner Particles

Any suitable emulsion aggregation procedure may be used to create the toner particles described herein. Suitable emulsion aggregation/coalescing processes for the preparation of toners, and which can be modified to include the heating and coalescence processes as described in the present disclosure, are illustrated in U.S. Pat. Nos. 5,290,654, 5,278,020, 5,308,734, 5,370,963, 5,344,738, 5,403,693, 5,418,108, 5,364,729, and 5,346,797, the entire disclosures of the above-mentioned U.S. patents are totally incorporated herein by reference. Further processes, components and compositions that may be used with the processes of the present disclosure may include those described in U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,977,210, 6,627,373; 6,656,657; 6,617,092; 6,638,677; 6,576,389; 6,664,017; 6,656,658; and 6,673,505 the entire disclosures of the above-mentioned U.S. patents are totally incorporated herein by reference. The appropriate components and process aspects of each of the foregoing U.S. patents may be selected for the present process and compositions thereof.

In forming the emulsion, the procedures may include process steps including, for example, aggregating an emulsion containing polymer binder, optionally one or more waxes, one or more colorants, one or more surfactants, an optional coagulant, and one or more additional optional additives to form aggregates; subsequently freezing the particle aggregates, and optionally an initial coalescing or fusing of the aggregates, and then recovering, optionally washing, and optionally drying the obtained emulsion/aggregation toner particles.

The emulsion aggregation processes may comprise dispersing in water a latex of a first polymer resin having a first glass transition temperature ($T_g$) and a colorant dispersion, and optionally adding to the emulsion a wax dispersion, and mixing the emulsion with high shear to homogenize the mixture. The homogenized mixture described above may be created using a traditional batch process, or as part of a continuous process. If the mixture is created using a batch process, the mixture may then be incorporated into a continuous process, for example, may be incorporated into a continuous process as described herein.

Following the preparation of the above homogenized mixture, an aggregating agent may be added to the mixture. The slurry may then be heated to a predetermined aggregation temperature of from about 30° C. to about 60° C., such as, for example, from about 30° C. to about 50° C., or from about 24° C. to about 60° C., or from about 49° C. to about 54° C. The heating may be conducted at a controlled rate of about 0.1° C./minute to about 2° C./minute, such as from about 0.3° C./minute to about 0.8° C./minute. The above steps may be completed and primary aggregated particles may be formed before the continuous coalescence processes described below are commenced, which results in the final toner particles described above.

Any suitable aggregating agent may be utilized in the processes of the present disclosure to form the toner particles, which optionally may be toner particles having a core/shell structure (as discussed below). Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. The aggregating agent may be added to the mixture at a temperature that is below the glass transition temperature (Tg) of the resin.

The aggregating agent may be added to the mixture utilized to form a toner in an amount of, for example, from about 0.01% to about 8% by weight, such as from about 0.1% to about 1% by weight, or from about 0.15% to about 0.8% by weight, of the resin in the mixture.

The particles may be permitted to aggregate until an initial predetermined desired particle size is obtained. A particle composition comprising the initial predetermined desired particles is obtained before the addition of additional latex particles to form a shell structure. A predetermined desired size (of the initial particles, or the final toner particles) refers to the desired particle size to be obtained as determined prior to formation, and the particle size being monitored during the growth process until such particle size is reached. Samples may be taken during the growth process and analyzed, for example with a Coulter Counter, for average particle size. Once the predetermined desired particle size is reached, then the latex for the formation of the shell structure is added. The amount of added latex is based on the pre-defined particle formulation. The predetermined desired particle size is within the desired size of the final toner particles, such as, for example, within about 15% 10% of the desired diameter of the final toner particles, within about 2% of the desired diameter of the final toner particles, or within about 0.5% of the desired diameter of the final toner particles.

Core-Shell Structure

After aggregation, but prior to coalescence, a resin coating may be applied to the aggregated particles to form a shell over the aggregated particles to achieve particles having a core-shell structure with an approximate predetermined particle size. Such particles having a core-shell structure may be subject to the continuous coalescence processes in order to achieve the final toner particles. Suitable methods and resins for forming the core and shell structure are described in, for example, U.S. Patent Application Publication No. 2012/0258398, the disclosure of which is totally incorporated herein by reference. The shell resin may be the same as or different from the resin used to form the core particle.

The shell resin may be applied to the aggregated particles by any suitable method. The resins utilized to form the shell may be in an emulsion including any known surfactants. The emulsion possessing the resins may be combined with the aggregated particles described above so that the shell forms over the aggregated particles, such as aggregated particles having a particle size that is about equal to the initial predetermined desired particle size. The shell may have a thickness of up to about 5 microns, or of from about 0.1 microns to about 2 microns, or from about 0.3 microns to about 0.8 microns, over the formed aggregates.

The formation of the shell over the aggregated particles may occur while heating to a temperature of from about 30° C. to about 80° C., or from about 35° C. to about 70° C. The formation of the shell may take place for a period of time of from about 5 minutes to about 10 hours, or from about 10 minutes to about 5 hours.

Freezing Aggregation

Once the desired size of the particles to be acted on by the coalescence processes is achieved, the pH of the mixture may be adjusted with a base to a value of from about 3 to about 10, or from about 5 to about 9. The adjustment of the pH may be utilized to freeze, that is to stop, further toner growth and aggregation. The base utilized to stop toner growth may include any suitable base such as, for example, alkali metal hydroxides such as, for example, sodium hydroxide, potassium hydroxide, ammonium hydroxide, combinations thereof, and the like. Ethylene diamine tetraacetic acid (EDTA) may be added to help adjust the pH to the desired values noted above. The base suppresses further aggregation by suppressing the effects of the coagulant.

Before the slurry is heated to a coalescence temperature, the temperature of the slurry may reach a predetermined pH adjustment temperature, and the pH of the slurry may be reduced to a predetermined coalescence pH by adding an aqueous acid solution, such as, for example, $HNO_3$. Adjusting the pH to a predetermined coalescence pH may increase spheroidization and preserve particle size distribution by controlling circularity based on pH at high temperatures. Examples of these processes include those disclosed, for example, in U.S. Patent Application Publication No. 2011/0318685, the disclosure of which is totally incorporated herein by reference.

Coalescence

Once the final desired particle size of toner is achieved, the aggregated particles are coalesced.

The coalescence step may be carried out by continuously passing an aggregated toner slurry through at least one heat exchanger, where the at least one heat exchanger has been heated to a temperature suitable for coalescence. For example, the at least one heat exchanger may be heated to a temperature of from about 100° C. to about 150° C., such as from about 110° C. to about 145° C., or from about 120° C. to about 140° C.

The heat exchanger(s) may be a standard shell-tube heat exchanger. The shell-side of the heat exchanger may be exposed to a bath having a desired temperature, so as to heat or cool the heat exchanger to the desired temperature. For example, the bath may be a heated bath to increase the temperature of the at least one heat exchanger. The bath is an oil bath, such as a glycol bath or a glycol/water mixture bath.

A single heat exchanger may be used to conduct the coalescence step. In addition, the toner slurry may be passed through more than one heat exchanger during the heating and coalescence process. For example, the toner slurry may be passed through at least two heat exchangers, or for example, three or more heat exchangers.

For example, the slurry may be passed through at least one heat exchanger to heat and coalesce the particles at a desired coalescence temperature, as described above, and then the slurry may be passed through at least one additional heat exchanger to quench the temperature of the slurry after coalescence. After coalescence, the mixture may be quenched to below the glass transition temperature of the resin, such as a temperature below about 40° C. The cooling may be rapid or slow, as desired. A suitable cooling method may include introducing cold water to a jacket around at least one additional heat exchanger to quench. After cooling, the toner particles may be optionally washed with water, and then dried. Drying may be accomplished by any suitable method for drying including, for example, freeze-drying.

Because the at least one heat exchanger may be heated to a temperature greater than the boiling point of water at atmospheric pressure, the system may be pressurized, such as to a pressure that is sufficient (at the temperature selected for the heat exchanger) to avoid boiling the water component of the toner slurry. Atmospheric pressure refers, for example, to a pressure of about 760 torr, or about 1 atmosphere (atm). The term "pressurized" refers, for example, to a pressure of the heat exchanger system that is greater than atmospheric pressure, such as a pressure greater than about 1 atm, or greater than about 1.5 atm, or greater than about 2 atm.

The pressure may be maintained at any desired pressure, such as a pressure greater than the vapor pressure of water. In contrast to a coalescence step of a typical batch process, where the temperature is kept below the boiling point of water at atmospheric pressure (such as less than about 96° C.) so as to avoid evaporating the water component of the toner slurry and boiling off the water present in the batch reactor, the system according to the instant disclosure may be pressurized, and thus the temperature may be increased to temperatures above the atmospheric boiling point of water with minimal or no loss of water due to boiling of the water component of the toner slurry. For example, the system may be pressurized when the at least one heat exchanger is heated to a temperature of from about 100° C. to about 150° C., such as from about 120° C. to about 145° C., or from about 130° C. to about 140° C. Thus, in the processes of the present disclosure, the coalescence process to achieve the final rheological properties of the toner may be carried out at higher temperatures than typical batch processes.

As a result of these higher temperatures, the rate of spheroidization (coalescence) may be increased such that coalescence may be completed within a residence time on the order of minutes. For example, coalescence may be completed with a residence time at temperature of from about 1 second to about 15 minutes, such as from about 10 seconds to about 10 minutes, or from about 15 seconds to about 5 minutes, or from about 30 seconds to about 2 minutes. As used herein, "residence time at temperature" refers to the time the toner slurry spends at a target temperature, such as a temperature suitable for coalescence, after the toner slurry has been heated to the target temperature within a heat exchanger. The residence time at temperature may be different from the time the toner slurry spends within the heat exchanger. For example, the toner slurry may be heated to temperature within a heat exchanger, and then coalescence may be completed by flowing the slurry through an insulated length of tubing such that the temperature drop is minimized, and for a residence time of from about 1 second to about 15 minutes, such as from about 10 seconds to about 5 minutes, or from about 30 seconds to about 2 minutes. The toner slurry may reach temperature at the outlet of the heat exchanger. The toner slurry may reach temperature within the body of the heat exchanger.

In addition, the residence time of the toner may be used to control or adjust the rheological properties of the toner particles produced. For example, as the residence time of the toner particles decreases, the elastic modulus and/or viscous modulus of the toner particles increase.

Furthermore, because the desired rheological properties may be met by passing the aggregated toner slurry through the at least one heat exchanger with a residence time on the order of minutes, the throughput of the system may be dependent only on the size and temperature of the heat exchangers in the system. In contrast, batch processes are much longer, typically requiring hours (sometimes more than 10 hours) for the particles to reach the desired rheological properties, if at all.

The aggregated toner slurry may be preheated, for example to a temperature greater than the glass transition temperature (Tg) of the resin, before the toner slurry is heated to coalescence temperature in the at least one heat exchanger. The temperature of the preheating may be greater than the glass transition temperature of the resin, but less than the coalescence temperature. For example, the temperature of the preheating may be at a temperature of from about 5° C. to about 30° C. greater than the glass transition temperature of the resin, such as from about 7.5° C. to about 25° C. greater than the glass transition temperature of the resin, or from about 10° C. to about 20° C. greater than the glass transition temperature of the resin. The temperature of the preheating may be a temperature of from about ($T_g$+5° C.) to about ($T_g$+30° C.), such as from about ($T_g$+7.5° C.) to about ($T_g$+25° C.), or from about ($T_g$+10° C.) to about ($T_g$+20° C.). For example, the toner slurry may be heated to a temperature greater than about 60° C., such as from about 60° C. to about 110° C., or from about 63° C. to about 85° C., or from about 65° C. to about 75° C. For example, the toner slurry may be preheated to about 65° C.

The aggregated toner slurry may be preheated to a temperature greater than the glass transition temperature of the resin before the toner slurry is added to the heat exchanger system. For example, the toner slurry may be preheated to a temperature greater than the glass transition temperature of the resin as a batch process in the aggregation vessel, or in a second vessel, before introducing the toner slurry to the heat exchanger system to continuously coalesce the particles. Pre-heating the slurry in the aggregation vessel prior to adding the slurry to the heat exchanger system eliminates the need for an additional piece of reaction equipment to carry out the preheating step.

By heating the toner slurry to a temperature greater than the glass transition temperature of the resin before introducing the toner slurry to the heat exchanger system, the continuous coalescence process does not produce any fines, which prevents a change in the geometric size distribution (GSD) of the toner. The term "fines" refers, for example, to toner particles having less than about 3 μm volume median diameter. Without being limited to a particular theory, by heating the slurry beyond the glass transition temperature of the resin, the weakly aggregated toner particles may fuse together, making them more robust against temperature shock from the rate of heating in the heat exchanger. Thus, when the slurry is heated to a temperature greater than the glass transition temperature of the resin in a batch process before the slurry is introduced into the heat exchanger system to continuously coalesce the particles, the system produces zero fines.

The preheated toner slurry may be introduced to the heat exchanger system immediately after it is heated to a temperature greater than the glass transition temperature of the resin, or it may be cooled and/or stored before being introduced into the heat exchanger system. Once the toner slurry, for example, an aggregated toner slurry, has been preheated, it may be added to the heat exchanger system at a temperature greater or less than the glass transition temperature of the resin. In other words, if the toner slurry has once been preheated to a temperature greater than the glass transition temperature of the resin, the toner slurry may be introduced to the heat exchanger system at a temperature less than the glass transition temperature of the resin without the generation of fines—that is, a toner slurry that has been cooled need not be reheated before being introduced into the heat exchanger system to avoid the generation of fines.

Without being bound by this theory, it is theorized that the heat exchangers transfer energy to the toner particles (in the form of heat), which allows for the rheological properties, such as the viscoelasticity, of the toner particles to be adjusted to desired amount.

As an alternative to the preheating before introduction into the heat exchanger system, the toner slurry may be preheated, such as to a temperature greater than the glass transition temperature of the resin, after being introduced to the heat exchanger system. In other words, the aggregated toner slurry may be preheated by passing the toner slurry through at least one heat exchanger heated to a temperature greater than the glass transition temperature of the resin but less than the coalescence temperature. For example, as discussed above, the toner slurry may be passed through a heat exchanger system comprising at least two heat exchangers, where the first heat exchanger and the second heat exchanger are heated to different temperatures.

For example, the first heat exchanger may be heated to a temperature greater than the glass transition temperature of the resin, but less than the coalescence temperature, to preheat the toner slurry to a temperature greater than the Tg of the resin, as described above. In embodiments, the first heat exchanger may be heated to a temperature of from about ($T_g$+5° C.) to about ($T_g$+30° C.), such as from about ($T_g$+7.5° C.) to about ($T_g$+25° C.), or from about ($T_g$+10° C.) to about ($T_g$+20° C.). For example, the first heat exchanger may be heated to a temperature of greater than about 60° C., such as from about 60° C. to about 110° C., or from about 63° C. to about 100° C., or from about 65° C. to about 75° C. The second heat exchanger may be heated to a temperature suitable for coalescence. For example, the second heat exchanger may be heated to a temperature of from about 100° C. to about 150° C., such as from about 110° C. to about 145° C., or from about 120° C. to about 140° C. As discussed above, the first heat exchanger may preheat the toner slurry to a temperature greater than the glass transition temperature of the resin, which prevents the large generation of fines.

The rate of temperature increase (° C./min) may be decreased as desired, such as decreasing the rate of temperature increase (° C./min) by half. Preheating in the first heat exchanger may also allow for some partial coalescence in the first heat exchanger. In embodiments this partial coalescence in the first heat exchanger may represent about 2% to about 20% of the coalescence process, or from about 5% to about 15% of the coalescence process. For example, the partial coalescence in the first heat exchanger may result in the particles that may have a mean circularity of from about 0.88 to about 0.94, such as from about 0.89 to about 0.93, or from about 0.90 to about 0.93. Such particles may then be further processed in subsequent heat exchangers to obtain the toner particles having a mean circularity of from about 0.930 to about 0.990, such as from about 0.940 to about 0.985, or from about 0.945 to about 0.980. This initial fusing yields more robust final toner particles after the toner slurry has passed through the second heat exchanger, thereby preventing the large generation of fines. This partial coalescence in the first heat exchanger may represent about 2% to about 20% of the coalescence process, or about 5% to about 15% of the coalescence process.

Alternatively, the toner slurry may pass through at least two heat exchangers, where a first heat exchanger may be at a higher temperature than a second heat exchanger. For example, the first heat exchanger may be heated to a temperature of from about 100° C. to about 150° C., such as from about 110° C. to about 145° C., or from about 120° C. to about 140° C. The second heat exchanger may be at a lower temperature than the first heat exchanger, such that the second heat exchanger quenches the temperature of the toner slurry after it exits the higher temperature heat exchanger. The second heat exchanger may reduce the temperature of the toner slurry to a temperature suitable for, for example, pH adjustment. For example, the second heat exchanger may reduce the temperature of the toner slurry in a range of from about 40° C. to about 90° C. below the coalescence temperature, such as from about 45° C. to about 80° C. lower than the coalescence temperature, or from about 50° C. to about 70° C. lower than the coalescence temperature. The pH of the slurry may be adjusted to a predetermined cooling pH of from about 7.0 to about 10, such as from about 7.5 to about 9.5, or from about 8.0 to about 9.0. This may be done by adding an aqueous base solution, such as, for example, NaOH. The temperature of the slurry may be maintained at the predetermined cooling pH adjustment temperature for any time period, such as a time period of from about 0 minutes to about 60 minutes, or about 5 to about 30 minutes, followed by cooling to room temperature. The system may further contain at least one additional heat exchanger to further quench the temperature of the toner slurry from the pH adjustment temperature to a temperature suitable for discharge, such as room temperature. Alternatively, there may be no pH adjustment, and the temperature may be quenched to a temperature suitable for discharge, which may be a temperature lower than the glass transition temperature (Tg) of the toner.

The toner slurry may be passed through more than one heat exchanger maintained at the same temperature. For example, two or more heat exchangers may be connected in series and heated to the same temperature on the shell side of the heat exchangers, such as with the same heating utility, such that the two or more heat exchangers may function as a single, longer heat exchanger.

In a heat exchanger system comprising at least one heat exchanger, the residence time within any single heat exchanger may be from about 0.1 minute to about 30 minutes, such as from about 1 minute to about 15 minutes, or from about 3 minutes to about 10 minutes. The total residence time of the toner in a heat exchanger system comprising at least one heat exchanger is the sum of the residence times of the individual heat exchangers in the system. Thus, the total residence time of the toner in the heat exchanger system depends on the number of heat exchangers in the system, and the temperature of each heat exchanger.

Additionally, a system of heat exchangers may be connected in such a way that energy may be recovered from the coalescence process described above, thereby yielding greater energy efficiency in the process. For example, the system may comprise at least three heat exchangers, wherein the first and third heat exchangers are connected in a closed loop, and the second heat exchanger may be heated to a temperature suitable for coalescence. The first heat exchanger may preheat the incoming toner slurry prior to the slurry passing through the second (higher temperature) heat exchanger, and the third heat exchanger may cool the toner slurry after it passes through the second (higher temperature) heat exchanger. For example, the first heat exchanger may increase the temperature of the toner slurry from its initial temperature to a temperature of from about 51° C. to about 95° C., such as from about 51° C. to about 85° C., or from about 60° C. to about 79° C. The second heat exchanger may be heated to a temperature of from about 100° C. to about 150° C., such as from about 110° C. to about 145° C., or from about 120° C. to about 140° C. The third heat exchanger, which may be connected in a closed loop with the first heat exchanger, may cool the toner slurry to a temperature of from about 60° C. to about 100° C., such as from about 70° C. to about 90° C., or from about 75° C. to about 85° C., after the toner slurry exits the second heat exchanger. In a system where the first and third heat exchangers are connected in a closed loop, for example, energy that is input into the system to heat the toner slurry may be recovered.

As discussed above, the system may be pressurized, such that an average pressure may be maintained, for example, at value greater than the vapor pressure of water. In such a pressurized system, the temperature may be increased to temperatures above the atmospheric boiling point of water without boiling the water component of the toner slurry. For example, the pressure of one or more of the heat exchangers of the system and/or the entire system may be maintained at a pressure greater than the vapor pressure of water. The pressure of one or more of the heat exchangers of the system and/or the entire system may be maintained at a predetermined temperature and pressure where the pressure may be from about 1% to about 800% greater than the vapor pressure of water (at the predetermined temperature), such as from about 1% to about 20% greater, or from about 5% to about 10% greater, or from about 10% to about 30% greater than the vapor pressure of water (at the predetermined temperature), or from about 15% to about 25% greater than the vapor pressure of water (at the predetermined temperature). For a given temperature, the pressure of one or more of the heat exchangers of the system and/or the entire system may be about 10% greater than the vapor pressure of water.

The temperature and pressure of the one or more of the heat exchangers of the system and/or the entire system are set to prevent the water component of the toner slurry from boiling. For example, at elevated pressures above one atm, one or more of the heat exchangers of the system and/or the entire system may be heated to temperatures above the boiling point of water at atmospheric pressure (for example above about 100° C., or in a range of from about 100° C. to about 200° C.). Because one or more of the heat exchangers of the system and/or the entire system is pressurized, the toner slurry may be heated to temperatures above the atmospheric boiling point of water without boiling the water component of the toner slurry. The pressure of the system may be maintained at a predetermined pressure by a back pressure regulator, a peristaltic pump, a gear pump, or a progressive cavity pump. The system may maintain a predetermined pressure by discharging through a back-pressure regulating diaphragm valve, which allows for discharge to the atmosphere.

The slurry may be heated to a predetermined coalescence temperature, and the temperature of the slurry may be maintained at that temperature that allows the particles to coalesce. High temperatures, such as from about 100° C. to about 150° C., or from about 110° C. to about 145° C., or from about 120° C. to about 140° C., may be used in one or more of the pressurized heat exchangers of the system to increase the rate of spheroidization such that coalescence may be completed within a residence time on the order of minutes. For example, residence time of the slurry from about 1 second to about 15 minutes, such as from about 15 seconds to about 5 minutes, or from about 30 seconds to about 2 minutes in one or more of the pressurized high-temperature heat exchangers of the system of the present disclosure may be sufficient to achieve the desired coalescence and target spheroidization. A residence time of the slurry in one or more of the pressurized high-temperature heat exchangers of the system of the present disclosure of less than about 2 minutes may be sufficient to achieve the desired coalescence and target spheroidization.

In addition, as discussed above, the residence time of the toner slurry may be changed to achieve the desired rheological properties of the toner particles.

Coalescence may take place entirely within one or more heat exchanger(s); meaning that the toner slurry, such as a frozen and aggregated toner slurry, is continuously added to the one or more heat exchanger(s), and fully coalesced particles having the desired rheological properties may be recovered continuously from the one or more heat exchanger(s).

The end coalesced particles may be periodically measured to determine the rheological properties, for example, the viscoelasticity, of the coalesced toner particles. The viscoelasticity of the coalesced toner particles may be adjusted by changing the residence time of the slurry in the heat exchangers. For example, a lower elastic modulus and viscous modulus may be achieved by increasing the residence time of the toner slurry in the heat exchanger(s), and a higher elastic modulus and higher viscous modulus may be achieved by decreasing the residence time of the toner slurry in the heat exchangers. The residence time of the toner slurry may be controlled by adjusting the flow rate of the toner slurry the heat exchanger(s). For example, a faster flow rate correlates to a shorter residence time of the toner slurry in the heat exchanger(s), and a slower flow rate correlates to a longer residence time of the toner slurry in the heat exchanger(s).

The total residence time of the toner slurry in each heat exchanger may be from about 1 second to about 15 minutes, such as from about 10 seconds to about 10 minutes, or from about 15 seconds to about 5 minutes, or from about 30 seconds to about 2 minutes.

The following Examples are being submitted to illustrate embodiments of the present disclosure. Also, parts and percentages are by weight unless otherwise indicated.

EXAMPLES

A series of particles were made through the freeze step in the aggregation process with the same formulation and under the same processing conditions. After aggregation, some of the toner particles underwent a continuous coalescence process, while toner particles were coalesced in batch process. A total of nine toner particle batches were made with coalescence by a continuous process, and sixteen batches were made with coalescence by batch process. The particles that were coalesced by a continuous process were coalesced with different residence times to determine if the characteristics of these toner particles result in different characteristics from toner particles produced by a batch process. The particles coalesced by a batch process were coalesced under standard temperature, time, and pH conditions.

Preparation of an Aggregated Toner Particle Slurry

An aggregated toner slurry was prepared by charging a 20 gallon reactor with 33.95 kg of de-ionized water, 14.9 kg of a styrene-butylacrylate resin in a latex emulsion having a solids content of about 41.5%, and 4.16 kg of a Cabot Regal R330 carbon black pigment dispersion having a solids content of about 17%. The contents in the reactor were then mixed together.

After mixing, 3.20 kg of Cytech Q-436 polymethylene wax dispersion having a solids content of about 31%, 0.80 kg of a Cytech N-539 paraffin wax dispersion having a solids content of about 31%, and 0.198 kg of an acid solution of polyaluminum chloride was added to the mixture. The wax dispersions were added through a homogenization loop to ensure that large agglomerates were broken down into smaller size particles. After the wax dispersion and the solution of polyaluminum chloride were added to the reactor, the components in the reactor were homogenized for forty-five minutes, or until the size distribution of the particles in the dispersion is such that the percentage on a volume basis between 5 and 12 microns is less than 2%. The particle size was determined using a Beckman Coulter Multisizer III.

After the ingredients in the reactor were homogenized, the temperature of the mixture was raised to about 51.5° C., until the particles aggregate and reach the target size of about 5.3 to 5.5 microns. The particle size was measured using a Beckman Coulter Multisizer III. At this point, the pre-shell aggregate or core formation has been completed.

Once the particles reached the target size discussed above, an additional 7.59 kg of a styrene-butylacrylate resin in a latex emulsion was added into the reactor. The latex was mixed into the reactor until the particles reached their final target size of about 6.4 to 7.0 microns, and at least 30 minutes have elapsed between the end of the shell addition and the time when the particles in dispersion reach the target size. It has been determined that 30 minutes is sufficient time to incorporate all of the additional latex emulsion onto the surface of the core particles. When this condition is achieved, the concentration of fine particles smaller than three microns stabilizes and reaches a plateau.

Once the target size was reached and the shell formation step was completed, the growth of the particles was stopped by adjusting the pH of the aggregated toner slurry to a range of about 3.95 to about 4.05 using a 1 molar solution of sodium hydroxide. In addition, at the same time as the pH adjustment, 0.085 kg ethylenediamine tetraacetate (EDTA) was added to the aggregated particles. After reaching a pH in the range of about 3.95 to about 4.05, the pH of the aggregated toner slurry was further adjusted to a pH in the range of about 5.3 to about 5.5 using a 1 molar solution of sodium hydroxide.

The aggregated toner particles, including the shell, contain about 83% styrene-butylacrylate resin, 6% carbon black pigment, 8.8% polymethylene wax, and 2.2% paraffin wax. The carbon black pigment concentration was verified by performing Thermogravimetric Analysis (TGA) using a Q500 thermogravimetric analyzer from TA Instruments. The analysis is based on the weight loss of a sample over a wide range in temperature as the organic ingredients are decomposed due to the extreme temperatures. The wax concentration was verified by performing Differential Scanning calorimetry Analysis (DSC) using a Q100 differential scanning calorimeter from TA Instruments. This analysis is based on the rate of heat transfer required to maintain a sample at a specific temperature and how the rate of heat transfer changes when the sample or component within the sample undergoes a phase transition. By observing the changes in the heat transfer of the test sample and a reference, the instrument can measure the amount of heat absorbed or released by the sample during a phase transition. This information can then be used to determine the concentration of components within the sample that underwent a phase transition, for example, the concentration of the waxes in a toner sample. As discussed above, the aggregation process of all particles was the same and used the same formulation. In addition, once the pH was confirmed, the aggregated toner slurry proceeded to be the coalesced by a continuous process, or by a batch process, as described below.

Example 1: Continuous Coalescence of an Aggregated Slurry

In this example, an aggregated toner particle slurry was prepared in a 20-gallon batch reactor, as described above.

A holding tank was filled with about 70 L of the aggregated slurry was adjusted to a pH of 5.3 at about 20° C. using a 0.3 M nitric acid solution. The holding tank was then sealed and pressurized to 40 psi. The volumetric flow rate through the process was regulated at the outlet of the holding tank by means of a peristaltic pump, and was set to a volumetric flow rate of 2.7 L/min.

The aggregated slurry was passed through the tube-side of two heat exchangers each having a volume of about 1.4 L, arranged in series, and designated HEX 1 and HEX 2, respectively. The shell-side (jacket) temperature of each heat exchanger was set to 130° C. At the set volumetric flow rate, this yielded a heated residence time of about 30 seconds in each heat exchanger.

The slurry then passed through the residence time reactor which was a length of 1" tubing having a total volume of approximately 2.6 L. At the set volumetric flow rate, this yielded a residence time of about 1 minute.

The slurry was then passed through the tube-side of a third heat exchanger (HEX 3), such that the temperature of the slurry upon exiting the third heat exchanger was about 63°. The outlet temperature of the slurry from HEX 3 was controlled by varying the flow rate of chilled tap water having a temperature of about 5 to about 15° C. and flowing counter-currently through the shell-side (jacket) of HEX 3. The slurry was then pH adjusted, inline, by injecting a 1 M sodium hydroxide solution into the flow of the slurry at the exit of HEX 3.

After the sodium hydroxide was injected, the slurry passed through a static mixer having a length of 15 inches and a diameter of 1 inch. The slurry then passed directly through the tube-side of a final heat exchanger (HEX 4), which was cooled by tap water having a temperature between about 5 to about 15° C. on the shell-side (jacket) to quench the slurry. This resulted in an outlet temperature of about 30° C. to about 40° C. The coalesced toner particles were collected at the output end of HEX 4, and then washed and dried according to conventional procedures. However, before the washing and the drying of the coalesced toner particles, the mean circularity of the coalesced toner particles was determined. The resulting mean circularity as measured using a FPIA-Sysmex 3000, and was determined to be 0.967 for Example 1.

Examples 2-9: Continuous Coalescence of an Aggregated Toner Particle Slurry

Examples 2-9 are the same as Example 1, but used a different process pH and/or process flow rate, as listed in Table 1.

TABLE 1

Examples 1-9 Continuous Coalescence of an Aggregated Toner Particle Slurry

| Example | Process Flowrate | Process pH | pH Adjustment Temperature | HEX1/2 Jacket Temperature | HEX3 Outlet Temperature | HEX4 Outlet Temperature | Circularity |
|---|---|---|---|---|---|---|---|
| 1 | 2.70 kg/min | 5.30 | 20° C. | 130° C. | 63° C. | <40° C. | 0.967 |
| 2 | 2.70 kg/min | 4.80 | 20° C. | 130° C. | 63° C. | <40° C. | 0.978 |
| 3 | 1.35 kg/min | 5.30 | 20° C. | 130° C. | 63° C. | <40° C. | 0.980 |
| 4 | 1.35 kg/min | 4.80 | 20° C. | 130° C. | 63° C. | <40° C. | 0.987 |
| 5 | 2.37 kg/min | 5.25 | 20° C. | 130° C. | 63° C. | <40° C. | 0.967 |
| 6 | 3.37 kg/min | 5.00 | 20° C. | 130° C. | 63° C. | <40° C. | 0.962 |
| 7 | 2.00 kg/min | 5.50 | 20° C. | 130° C. | 63° C. | <40° C. | 0.965 |
| 8 | 3.37 kg/min | 5.50 | 20° C. | 130° C. | 63° C. | <40° C. | 0.951 |
| 9 | 2.05 kg/min | 5.00 | 20° C. | 130° C. | 63° C. | <40° C. | 0.970 |

Examples 10-25: Batch Coalescence of an Aggregated Toner Particle Slurry

Examples 10-25 are of aggregated toner particles that were coalesced in batch process. The particles from Examples 10-25 were made with the same formulation as those of Examples 1-9, but under a different set of conditions. Once the target size was reached and the shell formation step was completed, the growth of the particles was stopped by adjusting the pH of the aggregated toner slurry to a range of about 3.95 to about 4.05 using a 1 molar solution of sodium hydroxide. In addition, at the same time as the pH adjustment, 0.085 kg ethylenediamine tetraacetate (EDTA) was added to the aggregated particles. After reaching a pH in the range of about 3.95 to about 4.05, the pH of the aggregated toner slurry was further adjusted to a pH in the range of about 5.3 to about 5.5 using a 1 molar solution of sodium hydroxide. The aggregated slurry was then heated to 80° C. Once this temperature was reached, the pH of the aggregated slurry was measured to ensure that it was within a target pH range of about 5 to about 5.4. The particle slurry was then heated until it reached a temperature of 96° C. Once the temperature of 96° C. was reached, the temperature was held constant for three hours. During the three hours, the circularity of the particles was measured using a FPIA-Sysmex 3000. Within the three hour period of time, the pH of the slurry was adjusted to 6.5 to 7.1 by the addition of a 1 molar solution of sodium hydroxide. At the end of the three hour period, the temperature of the slurry temperature was lowered to 43° C. During the lowering of the temperature, when the temperature of the slurry reached 63° C., the pH of the slurry was adjusted to within the range of about 8.7 to about 8.9 by the addition of a 1 molar solution of sodium hydroxide.

TABLE 2

Examples 10-25 Batch Coalescence of an Aggregated Toner Particle Slurry

| Example | 80° C. pH | Coalescence Temperature | Coalescence Time | Circularity |
|---|---|---|---|---|
| 10 | 5.0-5.4 | 96° C. | 3 hrs. | 0.970 |
| 11 | 5.0-5.4 | 96° C. | 3 hrs. | 0.971 |
| 12 | 5.0-5.4 | 96° C. | 3 hrs. | 0.969 |
| 13 | 5.0-5.4 | 96° C. | 3 hrs. | 0.972 |
| 14 | 5.0-5.4 | 96° C. | 3 hrs. | 0.969 |
| 15 | 5.0-5.4 | 96° C. | 3 hrs. | 0.968 |
| 16 | 5.0-5.4 | 96° C. | 3 hrs. | 0.968 |
| 17 | 5.0-5.4 | 96° C. | 3 hrs. | 0.970 |
| 18 | 5.0-5.4 | 96° C. | 3 hrs. | 0.968 |
| 19 | 5.0-5.4 | 96° C. | 3 hrs. | 0.970 |

TABLE 2-continued

Examples 10-25 Batch Coalescence of an Aggregated Toner Particle Slurry

| Example | 80° C. pH | Coalescence Temperature | Coalescence Time | Circularity |
|---|---|---|---|---|
| 20 | 5.0-5.4 | 96° C. | 3 hrs. | 0.966 |
| 21 | 5.0-5.4 | 96° C. | 3 hrs. | 0.967 |
| 22 | 5.0-5.4 | 96° C. | 3 hrs. | 0.969 |
| 23 | 5.0-5.4 | 96° C. | 3 hrs. | 0.970 |
| 24 | 5.0-5.4 | 96° C. | 3 hrs. | 0.970 |
| 25 | 5.0-5.4 | 96° C. | 3 hrs. | 0.971 |

The viscous modulus, elastic modulus, and surface wax concentration was measured for all particles after the particles were washed and dried to a moisture content of less than 0.7% by weight. The viscous and elastic moduli were measured using an ARES G-2 parallel plate rheometer as described above. The results are summarized in Tables 3 and 4.

The amount of surface wax on the particle was determined by X-Ray Photoelectron Spectroscopy (also known as XPS) performed on particle samples conditioned at different temperatures. Samples were heated to the desired temperature in an aluminum hermetic pan in a Dynamic Scanning calorimetric analysis (DSC) unit. The samples were heated at a rate of 10° C./min until the sample is 5° C. below the desired temperature, and then heated at 1° C./min until the desired temperature is achieved. The sample is held at the desired temperature for 2 minutes before performing the XPS analysis. The DSC pans were presented to the X-ray source by adhering them to a stainless steel sample holder using double-backed conductive copper adhesive tape. A region of roughly 800 microns is analyzed for surface composition. To calculate the surface wax of a particle, the percent oxygen for the pure resin in the particle and the percent oxygen of the particle in question are calculated from the XPS instrument. These two values are then used in the following equation to determine the percent surface resin for the particle in question $$\frac{Atomicpercentoxygenof\ \text{pure resin sample(1)}}{100\%\ \text{resin}} = \frac{Atomicpercentoxygenof\ \text{toner sample(2)}}{\%\ surfaceresin}$$

The results are summarized in Tables 3 and 4.

In addition, the Melt Flow Index (MFI) of the toner particles was determined. The Melt Flow Index can be determined using a Tinius Olsen Extrusion Plastometer. The index is calculated from the amount of melted material that flows through a bore over a 10 minute period of time. The material is melted by heating it up to a temperature of 130° C. and the flow of the material is enabled by the action of a piston that pushes the material through the bore. Weights are added on top of the piston such that the combined weight of the piston and weights equals 5 kg. The Melt Flow Index is calculated using the equation:

$$\text{Melt Flow Index}=(427*L*D)/t,$$

where "L" is the length that piston travels in cm, "D" is the true density of the sample in g/cm$^3$, and "t" is the total piston travel time in seconds.

TABLE 3

Characterization of Examples 1-9

| Example | MFI, g/10 min | Rheology Temp. | Elastic Modulus (Pa) | Viscous Modulus (Pa) | % Wax on Surface: Room Temperature | 55° C. | 75° C. |
|---|---|---|---|---|---|---|---|
| 1 | 25.2 | 160° C. | 830 | 809 | 13 | 13 | 63 |
| 2 | 27.6 | 160° C. | 576 | 675 | 7 | 8 | 55 |
| 3 | 25.7 | 160° C. | 796 | 799 | 6 | 9 | 54 |
| 4 | 29.3 | 160° C. | 613 | 685 | 4 | 10 | 66 |
| 5 | 21.3 | 160° C. | 950 | 876 | 4 | 9 | 73 |
| 6 | 24.4 | 160° C. | 926 | 875 | 6 | 11 | 72 |
| 7 | 23.6 | 160° C. | 674 | 706 | 5 | 9 | 75 |
| 8 | 22.4 | 160° C. | 979 | 840 | 0 | 10 | 80 |
| 9 | 24.4 | 160° C. | 706 | 745 | 4 | 10 | 68 |

TABLE 4

Characterization of Examples 10-25

| Example | MFI, g/10 min | Rheology Temp. | Elastic Modulus (Pa) | Viscous Modulus (Pa) | % Wax on Surface: Room Temperature | 55° C. | 75° C. |
|---|---|---|---|---|---|---|---|
| 10 | 18.4 | 160° C. | 1305 | 1093 | 15 | 25 | 93 |
| 11 | 18.0 | 160° C. | 1146 | 1040 | 16 | 25 | 93 |
| 12 | 15.7 | 160° C. | 1398 | 1126 | 21 | 26 | 94 |
| 13 | 19.9 | 160° C. | 1162 | 1101 | 21 | 27 | 93 |
| 14 | 18.3 | 160° C. | 1246 | 1086 | 22 | 25 | 93 |
| 15 | 18.9 | 160° C. | 1321 | 1160 | 20 | 28 | 93 |
| 16 | 17.4 | 160° C. | 1274 | 1128 | 19 | 26 | 93 |
| 17 | 17.8 | 160° C. | 1090 | 1180 | 18 | 25 | 90 |
| 18 | 18.1 | 160° C. | 1412 | 1203 | 20 | 26 | 91 |
| 19 | 21.7 | 160° C. | 1242 | 1079 | 22 | 27 | 93 |
| 20 | 19.9 | 160° C. | 1446 | 1226 | 15 | 25 | 93 |
| 21 | 18.5 | 160° C. | 1232 | 1097 | | | |
| 22 | 19.5 | 160° C. | 1172 | 1041 | | | |
| 23 | 21.1 | 160° C. | 1112 | 1054 | | | |
| 24 | 16.7 | 160° C. | 1271 | 1063 | | | |
| 25 | 18.1 | 160° C. | 1165 | 1085 | | | |

FIG. 1 shows a comparison of the elastic modulus between the 9 particle batches made in a continuous coalescence process, and the 16 particle batches made in a batch coalescence process. Each dot in the figure represents the property of one batch. The horizontal lines represent the range of the expected mean value. The distance or range between the mean and the horizontal lines, also known as the Confidence Interval Around the Mean, is calculated from the standard deviation and size of the sample set and the desired confidence level. For these calculations we used a 95% degree of confidence, which is the most commonly used degree of confidence for high confidence models. This type of analysis is called the Determination of Confidence Limits Around the Mean. The results show that on average, the elastic modulus of toner particles made in a batch coalescence process is about 1250 Pa, and that on average, the elastic modulus of toner particles made in a continuous coalescence process is about 783 Pa. The results are summarized in Table 5.

Figure 2:
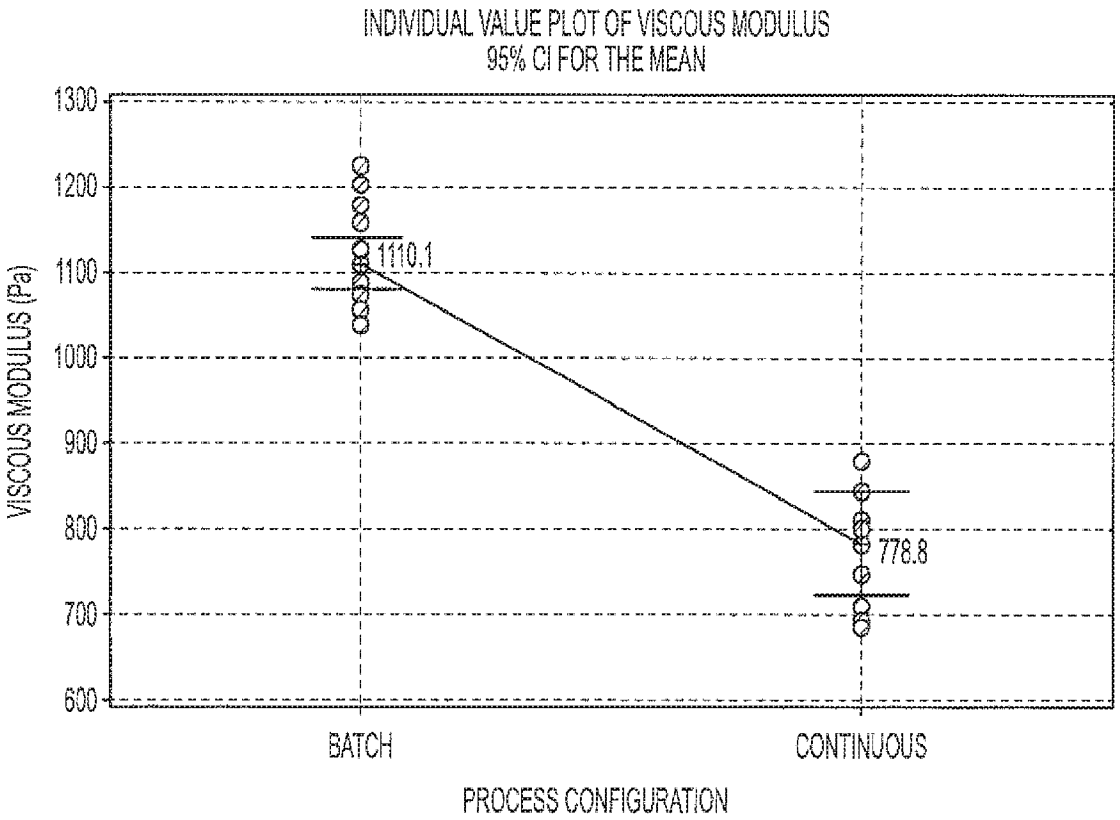
FIG. 2 is a graph comparing the viscous modulus between toner particles of the same formulation, except one group of toner particles were produced in a batch process and the other group was produced in a continuous process.

FIG. 2 shows a comparison of the viscous modulus between the 9 particle batches made in a continuous coalescence process, and the 16 particle batches made in a batch coalescence process. Each dot in the figure represents the property of one batch. The horizontal lines represent the range of the expected mean value. The distance or range between the mean and the horizontal lines is the Confidence Interval Around the Mean, as discussed above. The results show that on average, the elastic modulus of toner particles made in a batch coalescence process is about 1110 Pa, and for toner particles made in a continuous coalescence process, on average, the elastic modulus is about 779 Pa. The results are summarized in Table 5.

TABLE 5

| Parameter | Process Configuration: Batch Process | Continuous Process |
|---|---|---|
| Elastic Modulus (Pa) | 1249.6 | 783.3 |
| Viscous Modulus (Pa) | 1110.1 | 778.8 |

Figure 3:
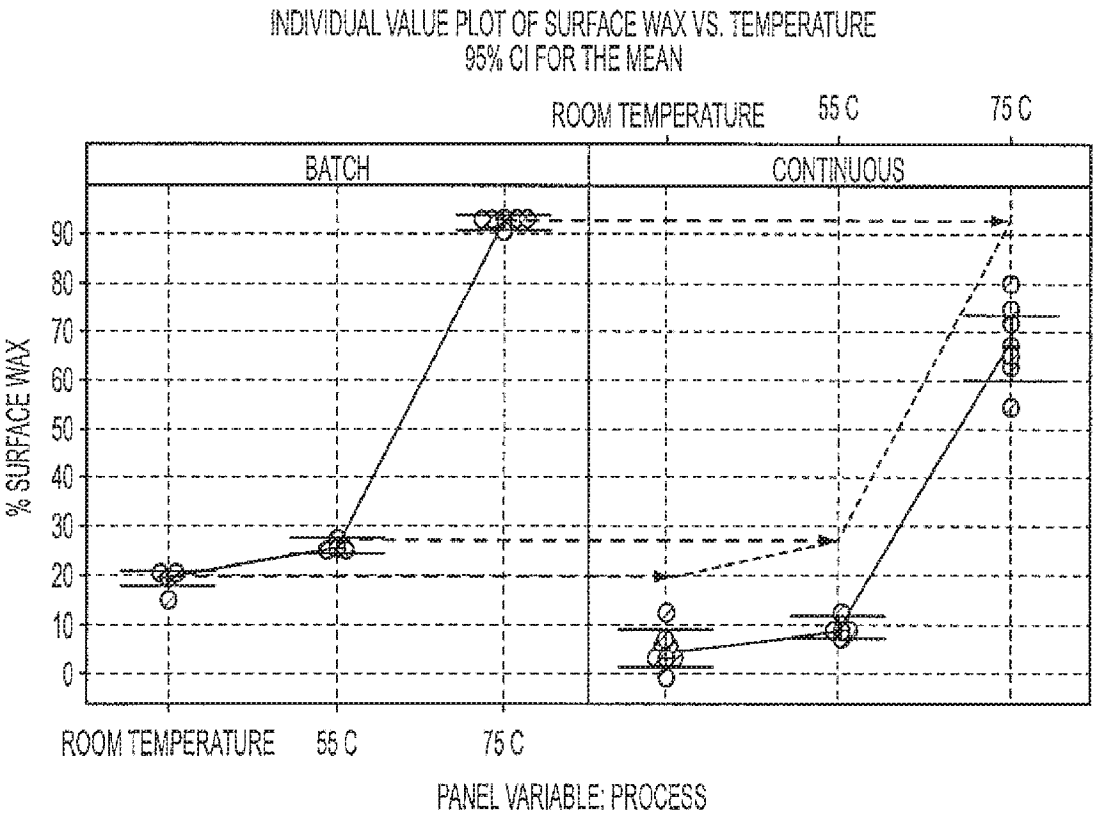
FIG. 3 is a graph comparing the amount of wax on the surface of the toner particles at different temperatures between toner particles of the same formulation, except one group of toner particles were produced in a batch process and the other group was produced in a continuous process.

FIG. 3 shows a comparison of the surface wax concentration at different temperatures between the 9 particle batches made in a continuous coalescence process, and the 16 particle batches made in a batch coalescence process. Each dot in the figure represents the property of one batch. The horizontal lines represent the range of the expected mean value. The distance or range between the mean and the horizontal lines is the Confidence Interval Around the Mean, as discussed above. The test results are shown in the form of two panels. The left panel shows the results from particles coalesced in a batch process, while the right panel shows the results from particles coalesced in a continuous process. From the data, it is evident that the continuous coalescence process leads to a lower concentration of wax on the particle surface at all temperatures. The dotted line in the right panel is an overlay of the results obtained from the batch process to help emphasize the difference. The results are summarized in Table 6.

TABLE 6

| Parameter | Process Configuration: Batch Process | Continuous Process |
|---|---|---|
| Surface Wax at Room Temperature | 19 | 5 |
| Surface Wax at 55° C. | 26 | 10 |
| Surface Wax at 75° C. | 93 | 67 |

It will be appreciated that various of the above-disclosed and other features and functions, or alternatives thereof, may be desirably combined into many other different systems or applications. Also, various presently unforeseen or unanticipated alternatives, modifications, variations, or improvements therein may be subsequently made by those skilled in the art, and are also intended to be encompassed by the following claims.

What is claimed is:

1. A continuous flow process for producing coalesced toner particles from aggregated toner particles, comprising:

continuously flowing a slurry of aggregated toner particles through one or more heat exchangers, wherein a residence time in the one or more heat exchangers is from about 1 second to about 15 minutes, thereby producing coalesced toner particles having a circularity of from about 0.930 to about 0.990;

wherein the aggregated toner particles comprise a polymer resin latex, a colorant, an aggregating agent, and an optional wax.

2. The process of claim 1, wherein a process flow rate of the slurry is in a range from about 1.35 kg/minute to about 2.7 kg/minute.

3. The process of claim 1, wherein the wax is either a single wax or a mixture of two or more waxes.

4. The process of claim 1, wherein the wax is selected from the group consisting of a natural vegetable wax, a natural animal wax, a mineral wax, a synthetic wax, a functionalized wax, and mixtures thereof.

5. The process of claim 4, wherein the natural vegetable wax is selected from the group consisting of carnauba wax, candelilla wax, rice wax, sumac wax, Japan wax, bayberry wax, and mixtures thereof.

6. The process of claim 4, wherein the natural animal wax is selected from the group consisting of beeswax, panic wax, lanolin, lac wax, shellac wax, spermaceti wax, and mixtures thereof.

7. The process of claim 4, wherein the mineral wax is selected from the group consisting of a paraffin wax, a microcrystalline wax, a montan wax, an ozokerite wax, a ceresin wax, a petrolatum wax, a petroleum wax, and mixtures thereof.

8. The process of claim 4, wherein the synthetic wax is selected from the group consisting of an acrylate wax; a Fischer-Tropsch wax; a fatty acid amide wax; a silicone wax; a polytetrafluoroethylene wax; a polyethylene wax; an ester wax; a polypropylene wax; and mixtures thereof.

9. The process of claim 1, wherein the polymer resin latex is selected from the group consisting of styrene acrylate, styrene butadiene, styrene methacrylate, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and combinations thereof.

10. The process of claim 1, wherein the slurry of aggregated toner particles of preselected size is heated to a temperature greater than the glass transition temperature (Tg) of the polymer resin latex but less than the coalescence temperature of the polymer resin latex prior to the continuously flowing step.

11. The process of claim 10, wherein the slurry of aggregated toner particles is heated to a temperature of from about 5° C. to about 30° C. greater than the Tg of the polymer resin latex.

12. The process of claim 1, wherein the residence time is from about 30 seconds to about 2 minutes.

13. The process of claim 1, wherein the toner particle circularity ranges from about 0.95 to about 0.99.

* * * * *